United States Patent [19]

Hudson

[11] 4,065,813

[45] Jan. 3, 1978

[54] BALL PLAYER'S GLOVE

[76] Inventor: Kirk R. Hudson, 2031 Asilomar Drive, Oakland, Calif. 94611

[21] Appl. No.: 699,288

[22] Filed: June 24, 1976

[51] Int. Cl.[2] ..... A41D 13/10

[52] U.S. Cl. ..... 2/19; 2/162

[58] Field of Search ..... 2/19, 160, 162

[56] References Cited

U.S. PATENT DOCUMENTS

| | | | |
|---|---|---|---|
| Re. 12,996 | 7/1909 | Peach | 2/19 |
| 704,579 | 7/1902 | Rollason | 2/162 |
| 811,389 | 1/1906 | Ferry | 2/19 |
| 950,083 | 2/1910 | Waring | 2/19 |
| 962,438 | 6/1910 | King | 2/19 |
| 2,113,731 | 4/1938 | Kennedy | 2/162 X |
| 2,995,756 | 8/1961 | Latiha | 2/19 |

FOREIGN PATENT DOCUMENTS

| | | | |
|---|---|---|---|
| 406,038 | 2/1934 | United Kingdom | 2/160 |

*Primary Examiner*—Werner H. Schroeder
*Assistant Examiner*—Moshe I. Cohen
*Attorney, Agent, or Firm*—Townsend and Townsend

[57] ABSTRACT

Ball player's gloves used in playing baseball, softball and similar sports are provided with an opening for insertion of the player's hand to manipulate the glove. A relatively short strap normally spans the opening to assist in holding the glove on the player's hand. The present invention provides an improvement in such gloves in which a relatively long strap is provided in place of the short strap. The long strap has one end attached to one side of the opening of the glove and a second opposite end detachably attachable to the other side of the opening. The longer strap has sufficient length so that it can be looped around the wrist of the player to secure the glove to the player so that the glove can be more readily manipulated and will not come off while it is being used.

3 Claims, 3 Drawing Figures

BALL PLAYER'S GLOVE

BACKGROUND OF THE INVENTION

The present invention provides a ball player's glove, and in particular, such a glove which is secured to the wrist of the player.

Different types of padded gloves are used in baseball, softball and other such games to provide a mechanism for catching the ball without injuring the player's hand. Such gloves have gradually evolved from a more traditional glove configuration into gloves which are much larger than the player's actual hand. Such gloves have an opening for the player's hand, and a relatively short strap covering the opening. The entire hand of the player does not fit into such modern gloves, but rather only the tips of the player's fingers fit into the "fingers" of the glove. The gloves are manipulated by the player's fingertips to provide control over the entire glove.

One of the difficulties with modern gloves is that the glove itself is very poorly secured to the player's hand, which is held in the glove only by the short strap covering the opening for the hand. Usually, the player's fingertips must be maintained in a flexed configuration so that the glove does not fall off when it is being held downwardly. If the player has a lapse in concentration, the glove can fall from the player's hand, and in any event the constant tension of the fingertips required to keep the glove on can cause discomfort to the player. Also, the glove cannot be as freely manipulated as desired by the player because of the relatively poor grip he has on the glove.

SUMMARY OF THE INVENTION

The present invention provides an improvement in ball player's gloves in which a relatively long strap is provided in place of the relatively short strap now used. The long strap has one end attached to one side of the opening of the glove and a second opposite end detachably attachable to the other side of the opening. The longer strap has sufficient length so that it can be looped around the wrist of the player to secure the glove to the arm of the player.

The present invention allows the use of fingertip control as required in large modern ball player's gloves. In fact, the glove can be manipulated more easily and with greater skill because there is less requirement that the glove be designed to stay on the player's hand and the glove becomes virtually an extension of the player's arm. Even with the fingertip control, the glove of the present invention is prevented from falling off the player's hand inadvertently by the relatively long strap which is wrapped around the wrist of the player.

The novel features which are believed to be characteristic of the invention, both as to an organization and method of operation, together with further objects and advantages thereof will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
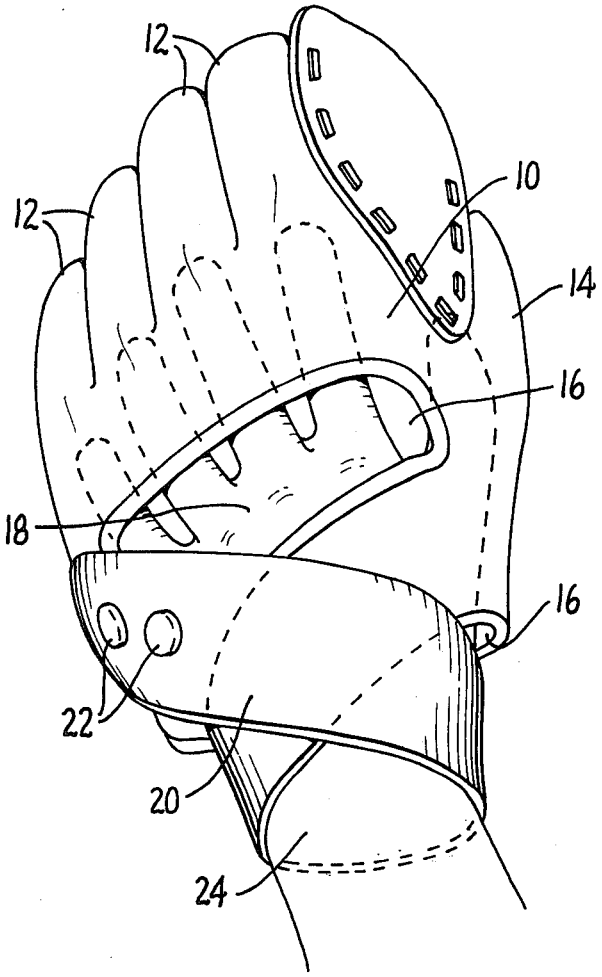
FIG. 1 is a perspective view of a baseball glove embodying the present invention.
Figure 2:
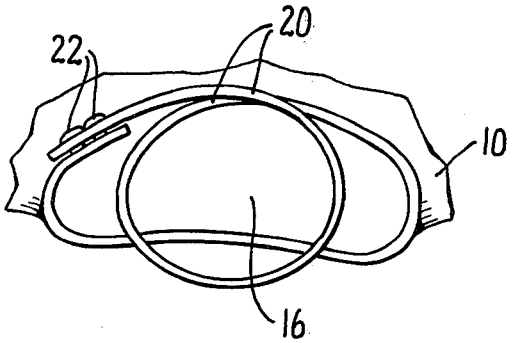
FIG. 2 is an elevation view of the glove of FIG. 1.

A baseball glove embodying the present invention is illustrated by way of reference to FIGS. 1 and 2. Glove 10 includes a plurality of "fingers" 12 and a "thumb" 14. Glove 10 also includes an opening 16 into which the hand 18 of a ball player is inserted. Only the fingertips of the ball player's hand 18 extend into the "fingers" 12 and "thumb" 14 of the glove 10.

Ordinarily, glove 10 is provided with a relatively short strap which extends from one side to the other of opening 16. However, the present invention provides a relatively long strap 20 fixed to one side of opening 16 in place of the short strap. Strap 20 is detachably attached by snaps 22 or other fasteners to the other side of opening 16. However, strap 20 is sufficiently long so that it can be wrapped around the wrist 24 of the player intermediate its ends so that glove 10 is firmly secured to the ball player's arm.

Figure 3:
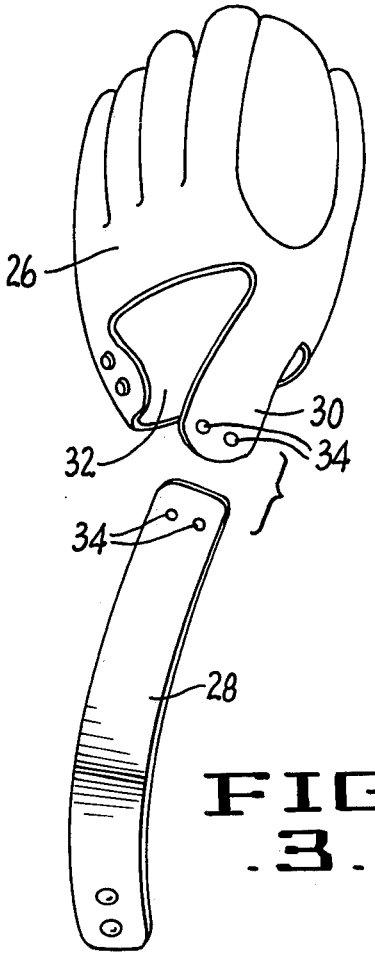
FIG. 3 is a perspective view of an alternate embodiment of the ball player's glove of the present invention.

An alternate embodiment 26 of the present invention is illustrated by way of reference to FIG. 3. In this embodiment, a relatively long strap 28 is detachably attachable to a strap element 30 emanating from one side of hand opening 32. Relatively long strap 28 can be fixed to strap 30 by means of snaps 34 or other such fasteners so that the relatively longer strap can be used as in the first embodiment.

As illustrated in FIG. 1, it is apparent that the ball player's glove, when fastened to the player using the apparatus of the present invention, becomes virtually an extension of the player's arm. As such, there is little likelihood of the glove coming off, and the glove can be more readily manipulated by the player. Thus, the skill of the player can be improved by utilizing the glove of the present invention.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. In a ball player's glove having an opening for the insertion of the player's hand to manipulate the glove, improved means for holding the glove on the player's hand comprising a strap means having one end attached to one side of the opening and a second opposite end, and means for detachably attaching the second end of the strap means to the other side of said opening, said strap means having sufficient length to loop completely around the wrist of the player intermediate its ends to secure the glove to the player so that the glove will not accidentally come off the player's hand and the glove can be manipulated more easily.

2. A ball player's glove as recited in claim 1 wherein said one end of the strap means is detachably attached to said one side of the opening so that the strap means can be removed from the glove.

3. A ball player's glove as recited in claim 1 wherein said attaching means comprises at least one snap.

* * * * *